United States Patent [19]

Cho et al.

[11] Patent Number: 5,034,653

[45] Date of Patent: Jul. 23, 1991

[54] ELECTRON GUN HAVING UNIPOTENTIAL FOCUSING LENSES FOR COLOR PICTURE TUBE

[75] Inventors: Suk-rae Cho; Sung-woo Lee, both of Suwon, Rep. of Korea

[73] Assignee: Samsung Electron Devices Co., Ltd., Rep. of Korea

[21] Appl. No.: 430,125

[22] Filed: Nov. 1, 1989

[30] Foreign Application Priority Data

Nov. 2, 1988 [KR] Rep. of Korea ..... 88-18095

[51] Int. Cl.[5] ..... H01J 29/48

[52] U.S. Cl. ..... 313/414; 313/449

[58] Field of Search ..... 313/412, 414, 449

[56] References Cited

U.S. PATENT DOCUMENTS 4,317,065 2/1982 Hughes ..... 313/414

4,443,736 4/1984 Chen ..... 313/414

4,701,677 10/1987 Ashizaki et al. ..... 313/414 X 4,825,120 4/1989 Takahashi ..... 313/449 X

*Primary Examiner*—Sandra L. O'Shea

*Attorney, Agent, or Firm*—Leydig, Voit & Mayer

[57] ABSTRACT

An electron gun for use in a color picture tube includes electrodes forming at least one unipotential focusing lens for focusing electron beams. An electrode disposed between first and second electrodes forming a unipotential focusing lens includes first and second plate-shaped members. The first member forms, in cooperation with the first electrode, a focusing lens having an electrostatic field weaker in the vertical direction than in the lateral direction. The second member forms, in cooperation with the second electrode, a focusing lens having an electrostatic field weaker in the vertical direction than in the lateral direction. The electron gun removes halos appearing in the peripheral region of the tube screen.

9 Claims, 9 Drawing Sheets

ELECTRON GUN HAVING UNIPOTENTIAL FOCUSING LENSES FOR COLOR PICTURE TUBE

FIELD OF THE INVENTION

The present invention relates to an electron gun having one or more unipotential focusing lenses for use in an in-line type color cathode ray tube, and particularly to an electron gun in which the focusing characteristics for the tube peripheral zones of the screen is improved.

Generally, electron guns for color cathode ray tubes are classified based on the contours of the electrostatic field formed around the main lens into unipotential type electron guns, uni-bi-potential type electron guns, multi-uni-bi-potential type electron guns, and the like. There are still other types of electron guns such as a combination of a unipotential type and bipotential type, and many other combinations. Various types of electron guns were developed for improving performance and lowering manufacturing costs.

Among the important factors influencing the performance of electron guns, are the electron beam focusing characteristics, convergence characteristics, and the like. These factors directly affect the image quality of cathode ray tube. The focusing characteristics affect the shape of the beam spot landing on the face of the screen, thereby greatly influencing resolution, while the convergence characteristics influence the color purity of the screen.

In order to improve the focusing characteristics and covergence characteristics, long experience and high technology are required. However, the electron guns developed so far do not show satisfactory performance so that improvements for electron guns are being demanded. The electron guns which are accepted at present as having relatively good characteristics are shown in FIGS. 1, 2 and 3 of the attached drawings. FIG. 1 illustrates a uni-bi-potential type electron gun having a unipotential electrostatic lens and a bipotential electrostatic lens. FIG. 2 illustrates a multi-uni-bi-potential type electron gun having three unipotential eletrostatic lenses and a bipotential electrostatic lens. FIG. 3 illustrates a unipotential type electron gun having only a unipotential electrostatic lens.

In the uni-bi-potential type electron as gun shown in FIG. 1, the electron beam is made to diverge focus by means of unipotential electrostatic fields formed by electrode G3, G4 and G5. The electron beam is finally accerlerated and focused by means of a bipotential electrostatic field formed by the electrode G5 and an electrode G6. More details of the uni-bi-potential type electron gun are explained in U.S. Pat. No. 4,318,027.

In the multi-uni-bi-potential electron gun shown in FIG. 2, the electron beam is focused in multistages and is preliminarily accelerated by means of three unipotential electrostatic fields formed between electrodes G3 and G8. The electron beam is finally focused and accelereated by means of bipotential electrostatic fields formed by electrodes G9 and G10. This type of electron gun is also described in U.S. Pat. No. 4,253,041.

In the unipotential type electron gun as shown in FIG. 3 and as explained in U.S. Pat. No. 4,496,877, the electron beam is focused and accelerated by means of a unipotential electrostatic field formed by electrodes G3, G4, and G5.

The above described electron guns having unipotential focusing lenses commonly show relatively good performance. But external factors, such as deflecting aberration due to non-uniform magnetic fields of the deflecting yoke and the flatness of the screen, create spot halos around the image as shown in FIG. 11. This phenomenon arises from the imperfect focusing characteristics occurring throughout the peripheral portion of the screen where it is more severe than at the center of the screen. It is necessary that the electron beam be properly changed within the electron gun in order to overcome these external factors.

Conventionally, in order to solve this problem, the G1 and G2 grids are provided with vertical and lateral slots and are changed properly in their thicknesses. Further depending on circumstances, the electrode of the main lens is provided with an elliptical or rectangular beam passing hole for intentionally deforming the beam spot so that desirable beam spots are formed around the image. However, that improvement is limited, and therefore, no fully satisfactory electron gun can be thereby achieved.

SUMMARY OF THE INVENTION

Therefore it is the object of the present invention to provide an electron gun for color cathode ray tubes having at least one unipotential focusing lens which is capable of improving the focusing characteristics throughout the peripheral portion of the screen of the color cathode ray tube by forming the unipotential electrostatic field within the main lenses in an effective manner.

To accomplish the above mentioned object, the electron gun of the present invention comprises cathodes as the source of emitted electrons, a control grid and a screen grid for forming the emitted electrons into an electron beam, and electrodes for focusing and accelerating the electron beam, forming at least one unipotential focusing lens, wherein the centrally positioned electrode of the three electrodes of the last unipotential focusing lens comprises a plate-shaped first member and a plate-shaped second member. The first member, in cooperation with the immediately prepositioned electrode, forms a focusing lens having an electrostatic field which is weaker in the vertical direction than in the lateral direction. The second member, in cooperation with the immediately postpositioned electrode, forms a focusing lens having an electrostatic field which is weaker in the vertical direction than in the lateral direction and which has a different field strength from that of the first member.

BRIEF DESCRIPTION OF THE DRAWINGS

The above object and other advantages of the present invention will become more apparent by describing the preferred embodiment of the present invention with reference to the attached drawings in which.

DESCRIPTION OF THE PREFERRED EMBODIMENTS

Figure 4:
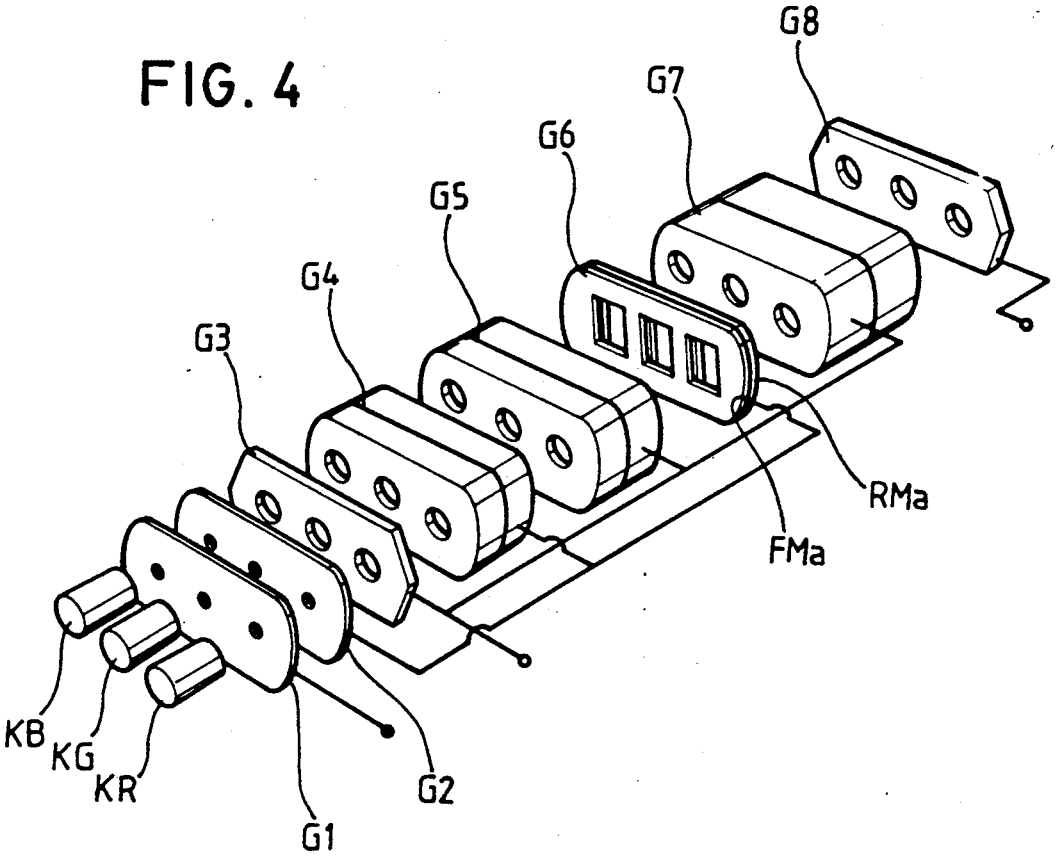
FIG. 4 is a schematic perspective view of the electron gun according to the present invention.

FIG. 4 illustrates a multi-uni-bi-potential type electron gun according to the present invention which sequentially, comprises cathodes KR,KG,KB arranged in-line for emitting electron beams, a control grid G1 facing the cathodes, a screen grid G2 facing the control grid G1, electrodes G3,G4,G5,G6 and G7 aligned at certain predetermined intervals, and an electrode G5 forming in cooperation with the electrode G7 a bipotential focusing lens positioned after the electrode G4. In the electron gun according to the present invention, the electrode G6, which represents a unique feature of the present invention, includes a first member FMa position at the beam incoming side and a second member RMa positioned at the beam outgoing side and combined with the first member.

Figure 5A:
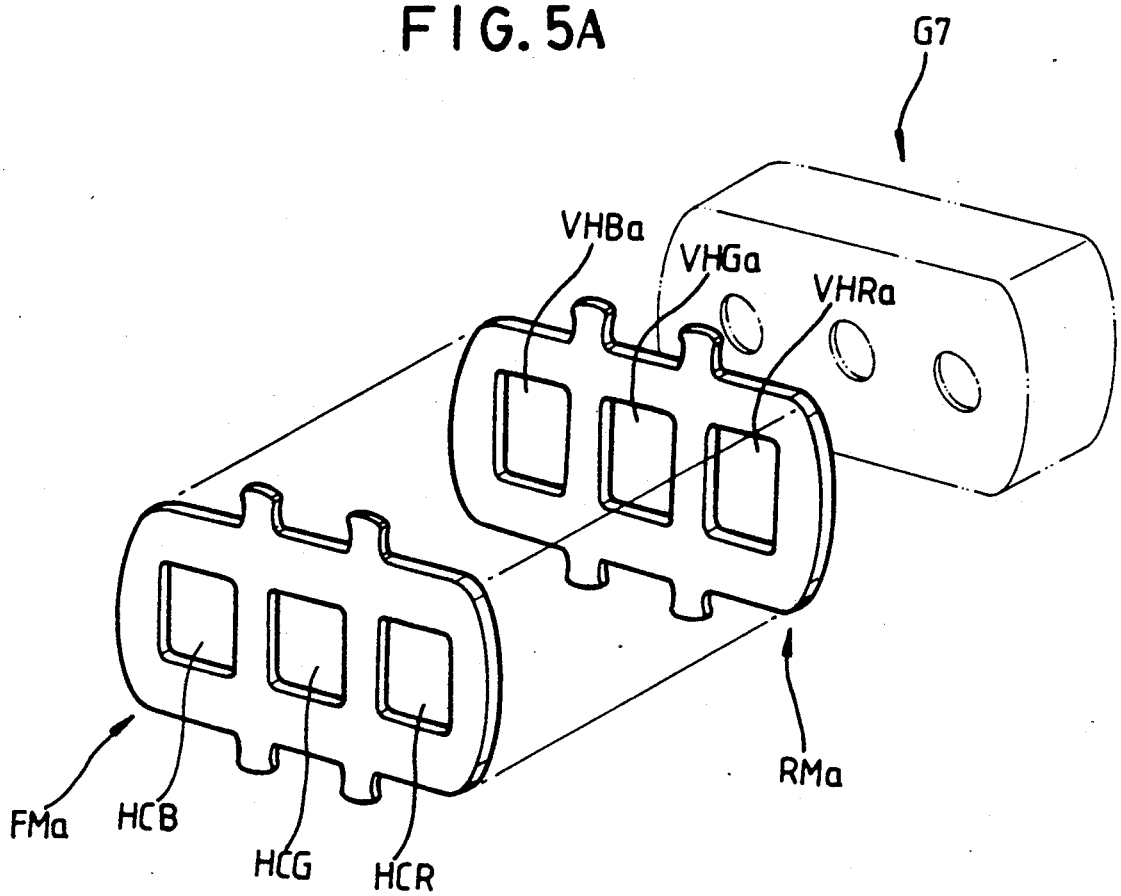
FIG. 5A is an exploded perspective view of an embodiment of the centrally positioned one of three electrodes of the last unipotential focusing lens in the electron gun according to the present invention.
Figure 5B:
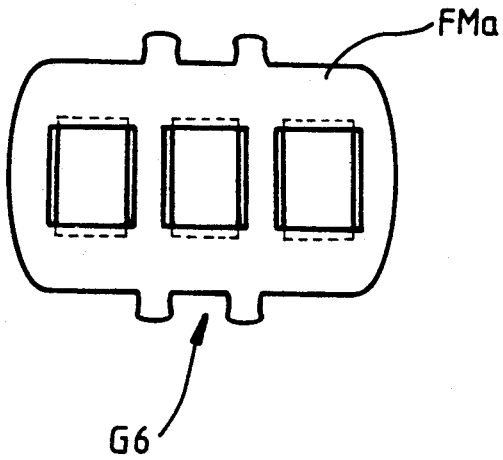
FIG. 5B is a frontal view of the electrode of FIG. 5A having two plate-shaped members.

The electrode G6 comprising the two members will now be described in more detail. As shown in FIG. 5A, the first member FMa and the second member RMa respectively include separate beam passing holes HCR,HCG,HCB and VHRa, VHGa and VHBa, whose vertical dimensions are longer than vertical dimensions of the beam passing holes formed in the electrode G5 and in the electrode G7. Further, the beam passing holes VHRa, VHGa and VHBa of the second member RMa are larger in a vertical direction and narrower in an orthogonal, lateral direction than the beam passing holes HCR, HCG and HCB of the first member FMa. When these members are combined as shown in FIG. 5B, the beam passing holes HCR, HCG and HCB of the first member are overlapped respectively by the beam passing holes VHRa, VHGa and VHBa of the second member so that the resultant beam passing holes are rectangles that have their longer sides along the vertical direction.

Figure 6A:
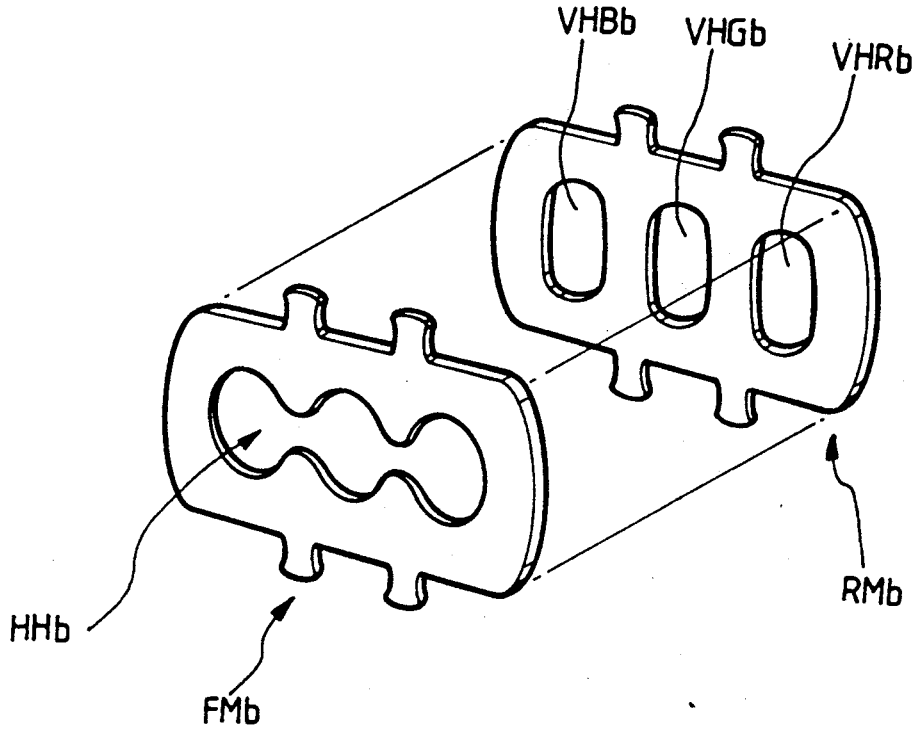
FIGS. 6A is an exploded perspective view of another embodiment of the electrode as shown in FIG. 5A.
Figure 6B:
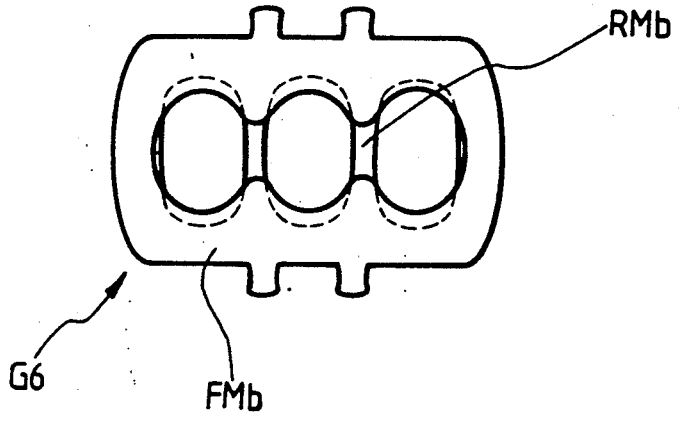
FIG. 6B is a frontal view of the electrode of FIG. 6A having two plate-shaped members.

Another embodiment of the electrode G6 in the electron gun according to the present invention is illustrated in FIGS. 6A and 6B. As shown in this drawing, a first member FMb includes a peanut-shaped laterally long beam passing hole HHb which looks like three intersecting elliptical holes, while a second member RMb includes three separate beam passing holes VHRb, VHGb and VHBb which are vertically oblong. As shown in FIG. 6B, the first and second members are combined so that the beam passing hole HHb of the first member overlaps the three separate beam passing holes VHRb, VHGb and VHBb. The resultant passing holes are approximately elliptical with a vertically long axis in which the opposite arc portions in the lateral direction are slightly collapsed.

Figure 7A:
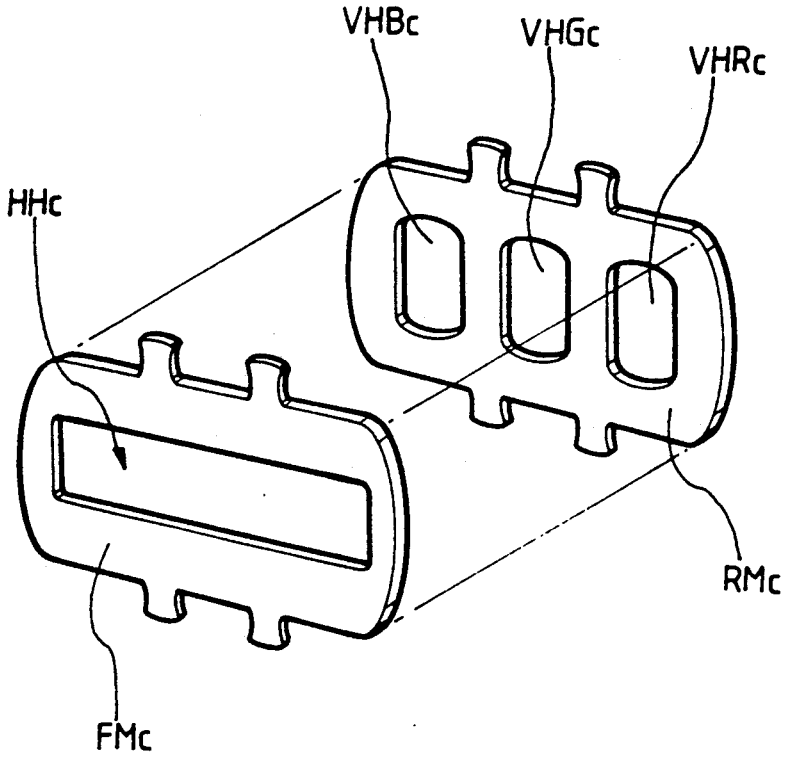
FIG. 7A is an exploded perspective view of a further embodiment of the electrode as shown in FIG. 5A which is formed by modifying the electrode of FIG. 5A.
Figure 7B:
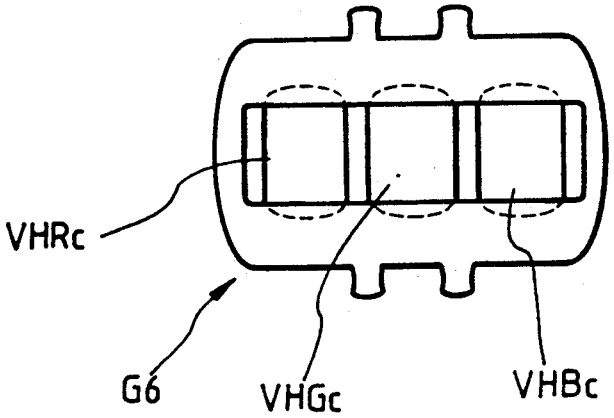
FIG. 7B is a frontal view of the electrode of FIG. 7A having two plate-shaped members.

Still another embodiment of the electrode G6 of the electron gun according to the present invention is illustrated in FIGS. 7A and 7B. In this electrode G6 which includes a first member FMc and a second member RMc. The first member FMc includes a laterally elongate rectangular beam passing hole HHc, while the second member RMc includes three separate, vertically oblong beam passing holes VHRc, VHGc and VHBc. When the first and second members are combined as shown in FIG. 8B, the laterally elongate hole HHc and the vertically long holes VHRc, VHGc and VHBc are overlapped. Here, the lateral edge portions of the laterally elongate beam passing hole HHc are aligned with the outer edges of the outer beam passing holes VHRc and VHBc of the second member or slightly extend beyond said edges. The resultant beam passing holes look like vertically long rectangles as shown in FIG. 7B.

Figure 8A:
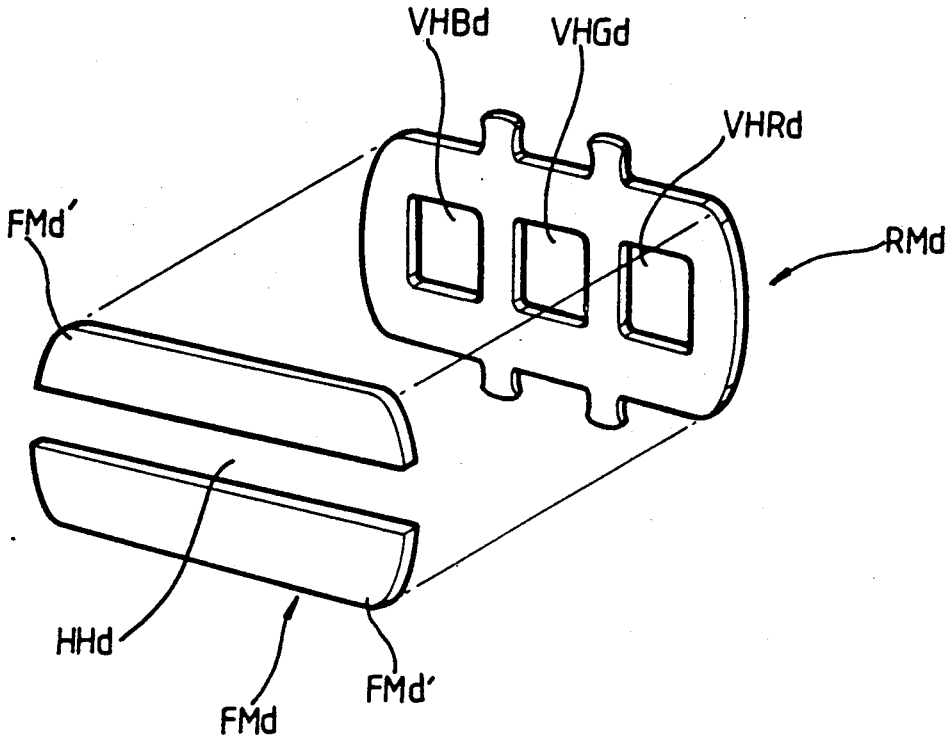
FIG. 8A is an exploded perspective view of a further embodiment of the electrode as shown in FIG. 5A.
Figure 8B:
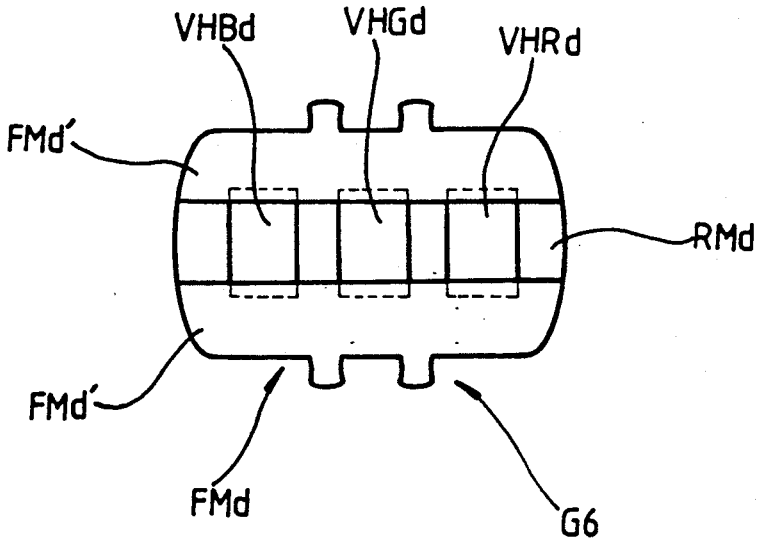
FIG. 8B is a frontal view of the electrode of FIG. 8A having two plate-shaped members.

Still another embodiment of the electrode G6 in the electron gun according to the present invention is illustrated in FIGS. 8A and 8B. In this embodiment, the electrode G6 includes a first member and a second member. The first member consists of separate upper and lower strips FMd', FMd', and has a shape which is formed by adding a slight modification to the first member of FIG. 7, while the second member has a shape that is the same as or similar to the second member of FIG. 7.

Further, in the embodiments of the electrode G6 shown in FIGS. 6, 7 and 8, the vertical dimensions of beam passing holes formed in the first members and the second members are also wider than the vertical dimensions of beam passing holes of electrodes G5 and G7 respectively.

The electrode G6 in the electron gun according to the present invention ultimately functions as a vertically weak focusing lens for the incoming beams, and also functions as a vertically weak focusing lens for the outgoing beams, the modifications being added to the electrode G6 for this purpose. All different embodiments of the electrode G6 in the electron gun according to the present invention are constructed to make the electron beam spot vertically long and, thus, to lower the astigmatic aberration due to the deflection yoke, by focusing the electron beam more weakly in the vertical direction than in lateral direction when the electron beam is passing via two steps. In one step the electron beam is decelerated and focused and in the other step the electron beam is accelerated and focused. The different embodiments of the electrode G6 according to the present invention have substantially the same function, but differences exist among the different embodiments in their manufacturing processes and assembling steps.

Now the electron gun of the present invention will be described in a more detail as to its functions and effects. First, the functions of the electrode G6 illustrated in FIGS. 5A and 5B will be described.

Figure 9A:
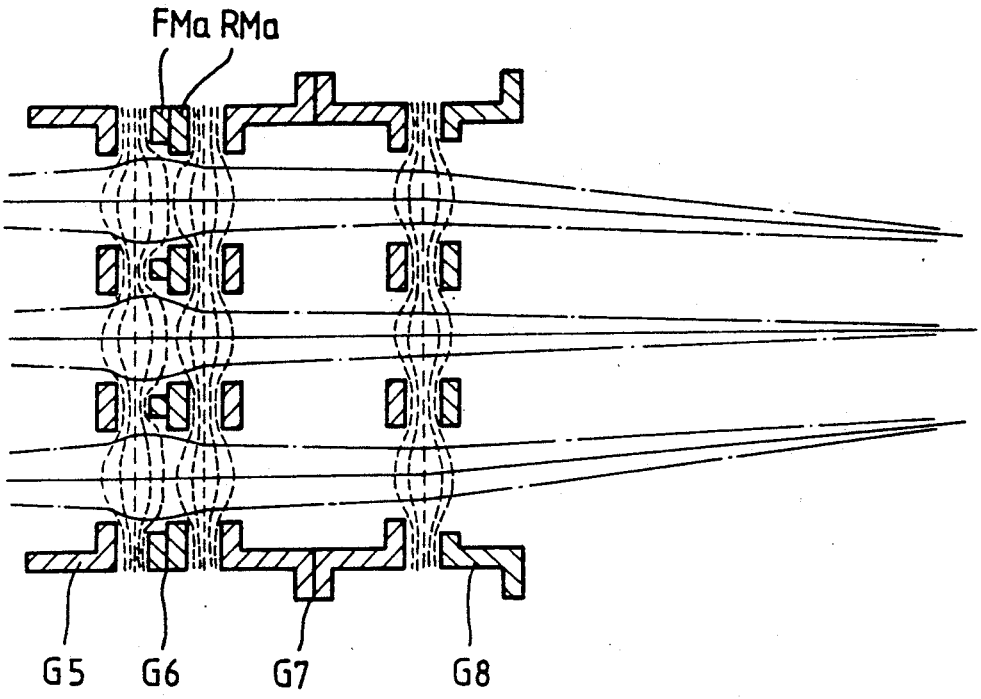
FIG. 9A is a partially sectional view of the electron gun including the 6th electrode shown in FIG. 5A, which illustrates the horizontal electric field distribution formed by the electrodes and the focusing state of the electron beams.
Figure 9B:
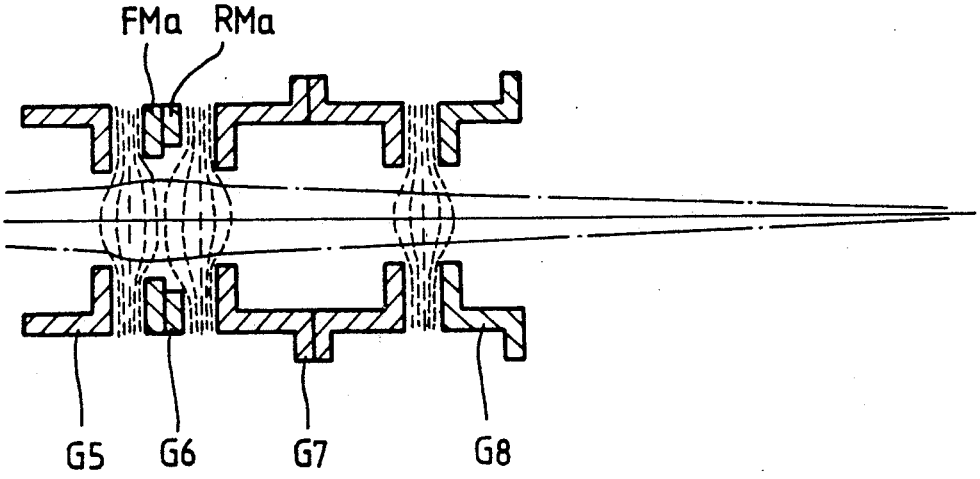
FIG. 9B is a partially sectional view corresponding to FIG. 9A, which illustrates the vertical electric field distribution formed by the electrodes and the focusing state of the electron beams.

The electrons emitted from the cathodes KR, KG, KB are formed into a beam by means of the control grid G1 and the screen grid G2. This electron beam thus formed is accelerated and focused by means of a plurality of the main focusing lenses which are formed by the electrodes G3 to G8. Before the electron beam advances toward the ultimate destination, the beam is modified into a more desirable form by means of the unipotential focusing lenses formed between the electrodes G3, G4, and G5, the unipotential focusing lenses formed between the electrodes G5, G6 and G7, and the bipotential focusing lens formed between the electrodes G7 and G8. By means of the above mentioned focusing lenses, the electron beam is controlled in the order of diverging - focusing - diverging - focusing - final accelerating and focusing. As shown in FIGS. 9A and 9B, when the beam is passing through the decelerating region formed by the electrode G5 and the first member of the electrode G6, the beam receives a strong focusing force which is weaker in the vertical direction than in the lateral direction at the vertically elongate beam passing hole HCR, HCG and HCB of the first member FMa of the electrode G6. When the beam is passing through the accelerating region formed by the second member RMa of the electrode G6 and the electrode G7, the beam receives a strong focusing force which is weaker in the vertical direction than in the lateral direction at the vertically long beam passing holes VHRa, VHGa, VHBa.

In more detail, the electron beam is decelerated and diverged between electrodes G5 and G6, and is subsequently decelerated and focused when approaching the first member of G6 and at the same time is influenced by the focusing force which is weaker in the vertical direction than in the lateral direction due to the asymmetrical electrostatic field formed by the vertically elongate beam passing holes HCB, HCG, HCR.

Then, the electron beam is again focused by the focusing force which is weaker in the vertical direction than in the lateral direction due to the asymmetrical electrostatic field formed by the vertically elongate beam passing holes when passing between electrodes G6 and G7. Subsequently the electron beam is influenced by the diverging force and the focusing thereof becomes somewhat weakened when approaching the electrode G7. Therefore, the electron beam is focused twice have a vertically long section when passing through the decelerating region and accelerating region formed by the electrodes G5, G6 and G7.

Figure 12:
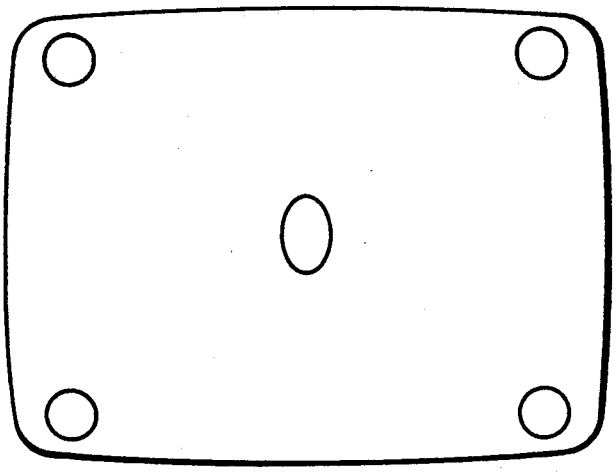
FIG. 12 is a frontal view of the screen using the electron gun of the present invention, in which the beam spots formed throughout the periphery of the screen are exaggerated.

Then, the electron beam which has been distorted to have such a vertically elongated section enters the final bi-potential focusing lens formed by the elctrodes G7 and G8 to be finally accelerated and focused by the final main lens. Thus, the peripheral portion of the electron beam is converged. Upon being finally accelerated, focused and converged the electron beam comes out of the electron gun and advances toward the screen of the color picture tube through the magnetic field formed by the deflection yoke and lands and is scanned across the whole area of the screen. When the electron beam which has already been distorted vertically lands on the periphery of the screen, the electron beam becomes distorted again laterally by the non-homogeneous magnetic field formed by the deflection yoke, with the result that the final shape of the electron beam formed on the screen becomes nearly circular as shown in FIG. 12.

Other embodiments of the electrode of the present invention as illustrated in FIGS. 6A, 7A and 8A have the same functions and operation as the embodiment shown in FIG. 5A. In these embodiments, the first member FMb, FMc and FMd are constructed such that they include a single laterally long beam passing hole HHb, HHc and HHd, respectively, instead of the three separate holes in the embodiment of FIG. 5A. On the other hand, the second members RMb, RMc and RMd include three separate vertically long beam passing holes, as in the embodiment of FIG. 5A.

Figure 10A:
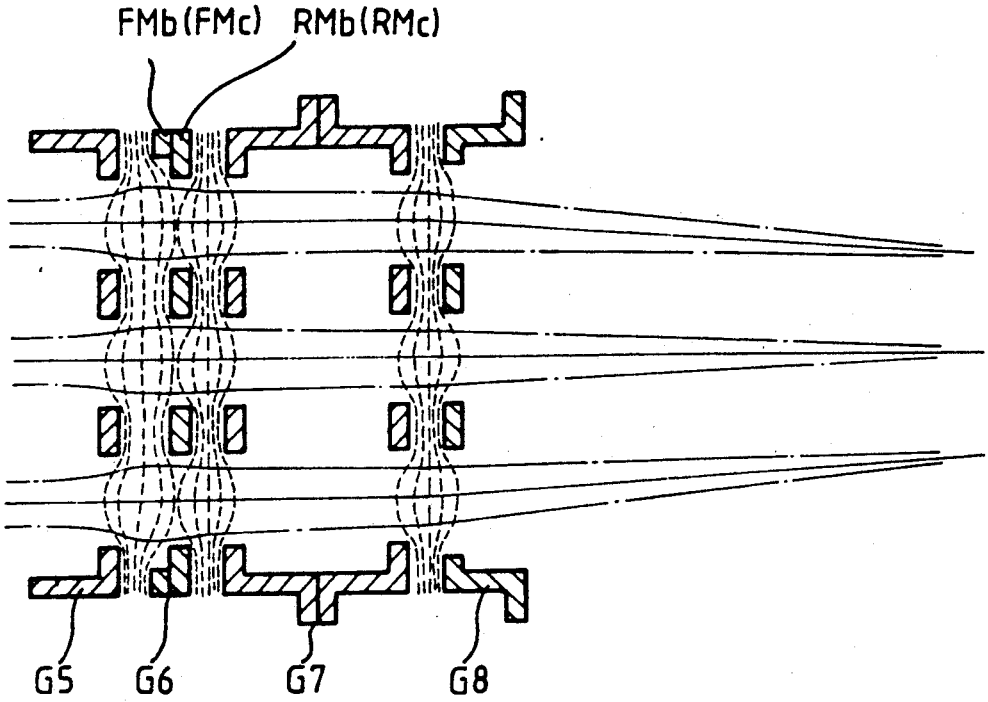
FIG. 10A is a partially sectional view of the electron gun including the 6th electrode shown in FIG. 6A, 7A and 8A, which illustrates the horizontal electric field distribution formed by the electrodes and the focusing state of the electron beams.
Figure 10B:
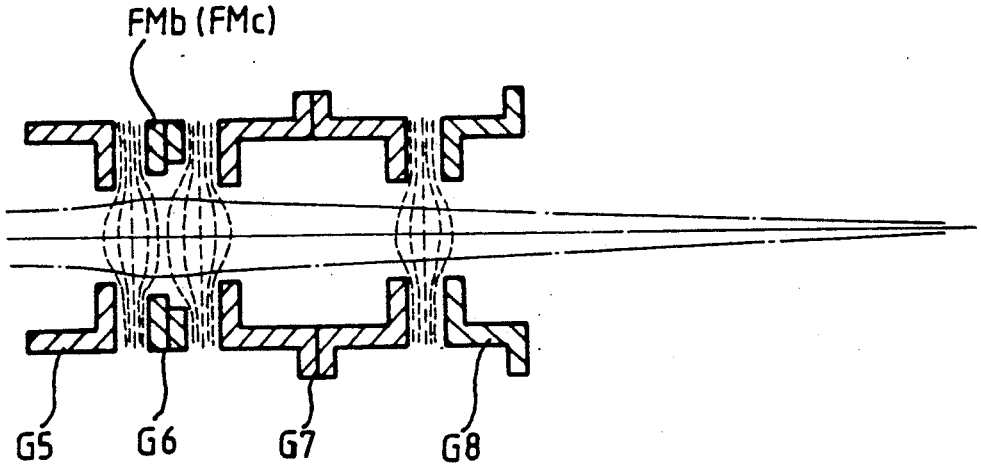
FIG. 10B is a partially sectional view corresponding to FIG. 10A, which illustrates the vertical electric field distribution formed by the electrodes and the focusing state of the electron beam.
Figure 11:
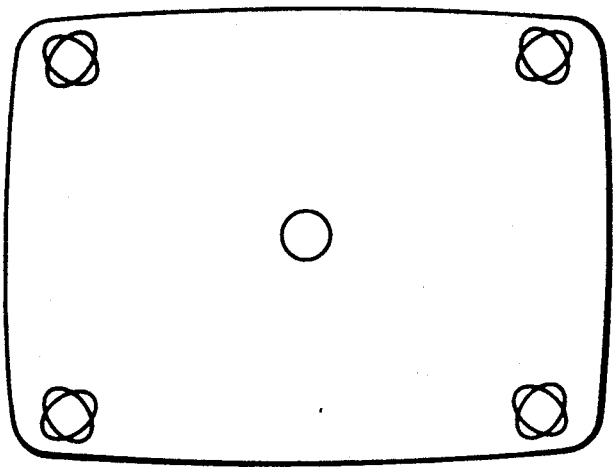
FIG. 11 is a frontal view of the screen using a conventional electron gun, in which the spot halos appearing throughout the periphery of the screen are exaggerated.

Therefore, the electron beams passing through these modified electrodes G6 are also distorted to have vertically elongated sections. That is, as illustrated in FIGS. 10A and 10B, the electron beam are focused by a unipotential electrostatic field when passing through the electrode G6, the paths of the electron beams being similar to those illustrated in FIGS. 9A and 9B.

The vertical dimensions of the vertically long beam passing holes in the electrodes G6 illustrated in FIGS. 5A, 6A, 7A and 8A can be varied, but are longer than the vertical dimensions of the beam passing holes of the electrodes G5 and G7. Therefore, the first member and the second member of the electrode G6 of the present invention are interchangeable each other so that the first member is placed at the beam outgoing side and the second member is placed at the beam incoming side bringing about the same effect as before.

Further, since the vertically elongated beam passing holes of different vertical dimensions overlap each other, precise adjustment of the focusing of the electron beam may be made thanks to the mutual compensation for the geometric errors of the overlapped first member and second member. In more detail, in case of the single common beam passing hole of the first member only, unintended distortions of the electron beam may occur on a large scale due to the geometric error of the beam passing hole. Therefore overlapping of vertically elongated beam pasing holes of different dimensions of the first member and the second member of G6 can counteract the effects of the geometric errors of the different beam passing holes to reduce the variance of the electric field and control the electron beam.

Among several embodiments of the electrodes G6 as described above, those shown in FIGS. 5A and 6A are most preferable in view of the fact that the regions through which each electron beam passes should be independent from each other and nearly circular.

Figure 1:
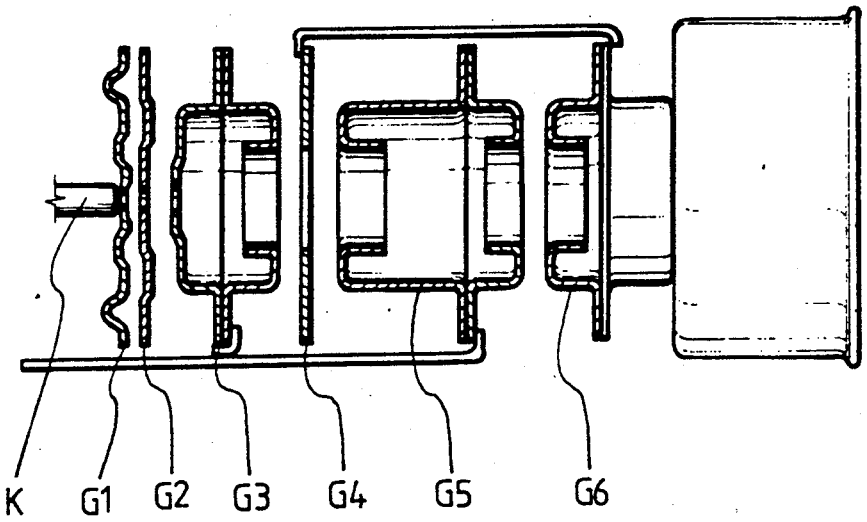
FIG.1 (Prior Art)
FIG. 1 is a sectional view of a conventional uni-bi-potential type electron gun.
Figure 2:
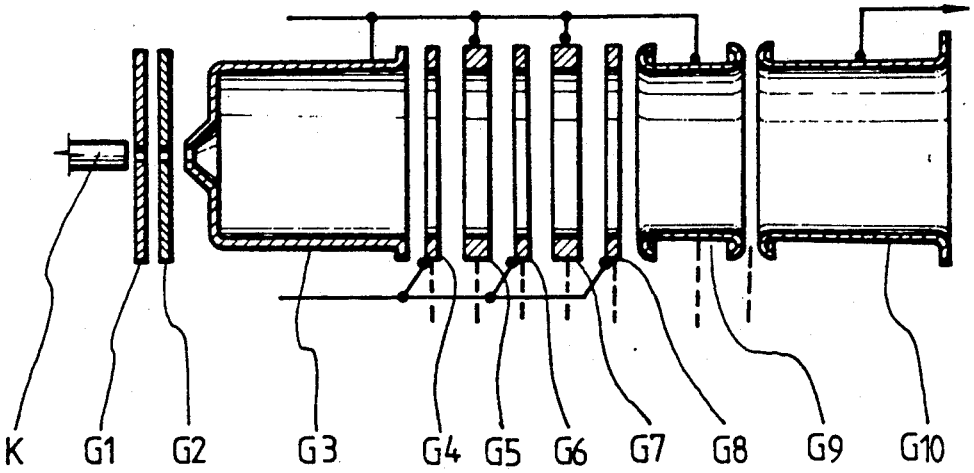
FIG. 2 (Prior Art)
FIG. 2 is a sectional view of a conventional multi-bi-potential type electron gun.
Figure 3:
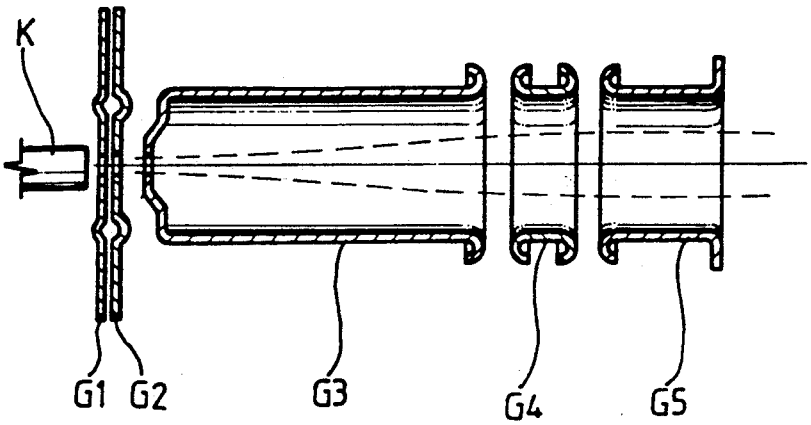
FIG. 3 (Prior Art)
FIG. 3 is a sectional view of a conventional unipotential type electron gun.

It is noted that, according to the present invention, the unipotential lenses are formed into proper shapes in such a manner that the distortion of the beam spots throughout the peripheral region of the screen can be compensated. The present invention is not limited to the embodiments described above, but is applicable to any electron gun which has at least one unipotential lens. For example, the present invention is applicable to conventional electron guns such as the uni-bi-potential type electron gun of FIG. 1, the multi-uni-bi-potential type electron gun of FIG. 2 and the purely unipotential type electron gun of FIG. 3. That is, in the case of a uni-bi-potential type electron gun, the electrode of the present invention consisting of the first member and the second member can be installed where a unipotential lens is formed before the bipotential focusing lens. In the case of a multi-uni-potential type electron gun, the electrode of the present invention is placed where the final unipotential focusing lens is formed. Finally, in the case of a purely unipotential electron gun, the electrode of the present invention is installed in place of the central low potential electrode among the electrodes forming unipotential electrostatic fields.

What is claimed is:

1. An electron gun for a color picture tube comprising:

a plurality of cathodes for emitting electrons;

a control grid and a screen grid for forming emitted electrons into a plurality of electron beams;

a plurality of electrodes forming at least one unipotential focusing lens for focusing and accelerating the electron beams, the unipotential focusing lens comprising first and second electrodes having pairs of mutually aligned beam passing holes for passage of the respective electron beams; and a middle electrode disposed between and electrically insulated from said first and second electrodes of the unipotential focusing lens, said middle electrode comprising first and second plate-shaped members electrically contacting each other, the first member forming, in cooperation with the first electrode, a focusing lens having a weaker electrostatic field in the vertical direction than in the lateral direction, the second member forming, in cooperation with the second electrode, a focusing lens having a weaker electrostatic field in the vertical direction than in the lateral direction.

2. The electron gun for a color picture tube as claimed in claim 1 wherein the first member and the second member each include three separate electron beam passing holes and the beam passing holes of the second member are larger in a vertical direction and smaller in a lateral direction, transverse to the vertical direction, than the beam passing holes of the first memeber.

3. The electron gun for a color picture tube as claimed in claim 1 wherein the first member includes a common beam passing hole for passing the plurality of electron beams, the common hole having a vertical dimension larger than the vertical dimensions of the beam passing holes in the first electrode and the second member includes three beam passing holes which are larger in vertical dimension than the holes in the first member and larger in vertical dimension than the holes in the second electrode.

4. The electron gun for a color picture tube as claimed in claim 3 wherein the common beam passing hole of the first member is peanut-shaped, resembling three intersecting elliptical holes.

5. The electron gun for a color picture tube as claimed in claim 3 wherein the common beam passing hole is defined by upper and lower lens strips.

6. The electron gun for a color picuture tube as claimed claim 2 wherein each of the beam passing holes in said first and second members is rectangular.

7. The electron gun for a color picture tube as claimed in claim 3 wherein each of the beam passing holes in the second member is rectangular.

8. The electron gun for a color picture tube as claimed in claim 4 wherein each of the beam passing holes in the second member is oblong.

9. The electron gun for a color picture tube as claimed in claim 5 wherein each of the beam passing holes in the second member is rectangular.

* * * * *